US008617326B1

(12) United States Patent
Schneider et al.

(10) Patent No.: US 8,617,326 B1
(45) Date of Patent: Dec. 31, 2013

(54) BIPROPELLANTS BASED ON CHOSEN SALTS

(75) Inventors: Stefan Schneider, Palmdale, CA (US); Tommy W. Hawkins, Lancaster, CA (US); Michael S. Rosander, Lancaster, CA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 262 days.

(21) Appl. No.: 12/567,136

(22) Filed: Sep. 25, 2009

(51) Int. Cl.

| | |
|---|---|
| ***C06B 47/00*** | (2006.01) |
| ***C06B 47/08*** | (2006.01) |
| ***C06B 47/04*** | (2006.01) |
| ***D03D 23/00*** | (2006.01) |
| ***D03D 43/00*** | (2006.01) |

(52) U.S. Cl.
USPC ..... 149/1; 149/36; 149/74; 149/109.2; 149/109.4

(58) Field of Classification Search
USPC ..... 149/36, 1, 74, 109.2, 109.4
See application file for complete search history.

(56) References Cited

U.S. PATENT DOCUMENTS

| | | | | |
|---|---|---|---|---|
| 3,552,127 | A * | 1/1971 | Morrel | 60/215 |
| 5,932,837 | A * | 8/1999 | Rusek et al. | 149/1 |
| 6,218,577 | B1 * | 4/2001 | Brand et al. | 564/464 |
| 6,378,291 | B1 * | 4/2002 | Schneider | 60/218 |
| 6,588,199 | B2 * | 7/2003 | Stechman et al. | 60/258 |
| 2003/0192633 | A1 * | 10/2003 | Diede | 149/109.4 |
| 2004/0221933 | A1 * | 11/2004 | Hallit et al. | 149/1 |
| 2005/0022911 | A1 | 2/2005 | Rusek et al. | |
| 2005/0269001 | A1 * | 12/2005 | Liotta et al. | 149/1 |

OTHER PUBLICATIONS

Wang et al. Chemistry—A European Journal, vol. 15, issue 11, Jan. 28, 2009.*
H. Gao et al., "Hypergolic Ionic Liquids with the 2,2-Dialkyltriazanium Cation", Angew. Chem. Int. Ed, 2009, pp. 2792-2795, vol. 48, Wiley-VCH Verlag GmbH & Co., KGaA, Weinheim.
United States Patent and Trademark Office, Second Advisory Action in U.S. Appl. No. 10/816,032, mailed Dec. 13, 2011, 2 pages.
United States Patent and Trademark Office, Third Final Office Action in U.S. Appl. No. 10/816,032, mailed Sep. 29, 2011, 7 pages.
United States Patent and Trademark Office, Third Non-Final Office Action in U.S. Appl. No. 10/816,032, mailed Mar. 28, 2011, 7 pages.
United States Patent and Trademark Office, Second Final Office Action in U.S. Appl. No. 10/816,032, mailed Oct. 27, 2009, 6 pages.
United States Patent and Trademark Office, Second Non-Final Office Action in U.S. Appl. No. 10/816,032, mailed Apr. 13, 2009, 6 pages.
United States Patent and Trademark Office, First Advisory Action in U.S. Appl. No. 10/816,032, mailed Dec. 16, 2008, 3 pages.
United States Patent and Trademark Office, First Final Office Action in U.S. Appl. No. 10/816,032, mailed Oct. 27, 2008, 5 pages.
United States Patent and Trademark Office, First Non-Final Office Action in U.S. Appl. No. 10/816,032, mailed May 3, 2007, 4 pages.
United States Patent and Trademark Office, First Non-Final Office Action in U.S. Appl. No. 12/567,110, mailed Sep. 16, 2011, 8 pages.
United States Patent and Trademark Office, First Final Office Action in U.S. Appl. No. 12/567,110, mailed Dec. 28, 2011, 10 pages.
United States Patent and Trademark Office, First Advisory Action in U.S. Application U.S. Appl. No. 12/567,110, mailed Jan. 11, 2012, 2 pages.
United States Patent and Trademark Office, Second Advisory Action in U.S. Appl. No. 12/567,110, mailed Mar. 1, 2012, 3 pages.
United States Patent and Trademark Office, Second Non-Final Office Action in U.S. Appl. No. 12/567,110, mailed Dec. 3, 2012, 11 pages.
S. Schneider et al., "Ionic liquids as hypergolic fuels," Energy & Fuels, vol. 22 (2008) 2871-2872.
S. D. Chambreau et al., "Fourier transform infrared studies in hypergolic ignition of ionic liquids," J. Phys. Chem. A., vol. 112 (2008) 7816-7824.
S. Schneider et al., Preprint of "Liquid azide salts and their reactions with common oxidizers IRFNA and N2O4," which was published in Inorg. Chem., vol. 47 (2008) 6082-6089.
United States Patent and Trademark Office, Final Office Action in related U.S. Appl. No. 12/567,110, mailed Jun. 5, 2013, 10 pages.
United States Patent and Trademark Office, Final Office Action in related U.S. Appl. No. 10/816,032, mailed Jun. 7, 2013, 8 pages.

* cited by examiner

*Primary Examiner* — James McDonough
(74) *Attorney, Agent, or Firm* — AFMCLO/JAZ; Chastity Whitaker

(57) ABSTRACT

Advanced bipropellant fuels with fast ignition upon mixing with storable oxidizer ($N_2O_4$, nitric acid) have been synthesized and demonstrated. The bipropellant fuels are based upon salts containing dicyanamide or tricyanomethanide anions and employ at least two hydrazine functionalities in the cations.

6 Claims, No Drawings

BIPROPELLANTS BASED ON CHOSEN SALTS

STATEMENT OF GOVERNMENT INTEREST

The invention described herein may be manufactured and used by or for the Government for governmental purposes without the payment of any royalty thereon.

CROSS-REFERENCE TO RELATED PATENT APPLICATIONS

This Application Relates to patent application Ser. No. 10/816,032 entitled Hypergolic Bipropellants by Hawkins et al, filed on 2 Apr. 2004 and also to a patent application entitled Bipropellants Based on Selected Salts by Hawkins et al, filed herewith, both of which are herein incorporated in their entirety by reference.

FIELD OF THE INVENTION

This invention relates to bipropellants, particularly hypergolic bipropellants.

BACKGROUND OF THE INVENTION

A conventional, storable bipropulsion system uses a hydrazine (e.g., monomethylhydrazine) as the fuel component. This fuel affords useful performance characteristics and has a fast ignition with the oxidizer. This fast (hypergolic) ignition provides system reliability for on-demand action of the propulsion system. The conventional, storable bipropulsion system is limited by its inherent energy density that can be traced, in large measure, to the density of the fuel. There are significant costs and operational constraints associated with handling the fuel that derives from the fuel's very toxic vapor.

The challenge is made more difficult since the fuel/oxidizer combination is desired to be hypergolic. Hypergolicity is defined as self-ignition that occurs within milliseconds after contact of fuel with oxidizer, herein "fast ignition." Hypergolic ignition is valuable because it offers high reliability, eliminates the inert mass of a separate ignition system, and provides an ability to restart for missions that require multi-pulse operation.

Accordingly, there is need and market for hypergolic bipropellants that overcome the above prior art shortcomings.

SUMMARY OF THE INVENTION

Broadly the present invention provides a hypergolic bipropellant that has an ionic liquid (IL) fuel containing a cation with at least two hydrazine moieties, in combination with at least one anion and an oxidizer.

The invention also includes the above IL fuel wherein the anion is dicyanamide $[N(CN)_2]$ or tricyanomethanide $[C(CN)_3]$ anions.

DESCRIPTION OF PREFERRED EMBODIMENTS

Referring to the present invention in detail, advanced bipropellant fuels with fast ignition, upon mixing with storable oxidizer, have been synthesized and demonstrated.

The bipropellant fuels are based upon salts containing the dicyanamide or tricyanomethanide anion (Formulas 1) below. The salts employ at least two hydrazine moieties in the cations (Formula 2) below.

Formulas 1

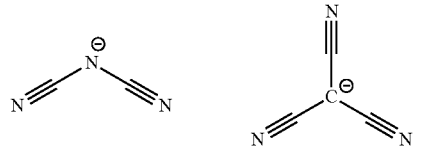

Formula 2

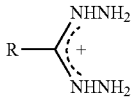

Reactivity evaluation of molten hydrazidine (Formula 2) based ILs with white fuming acid and nitrogen tetroxide was performed. The experimental results are shown in Table 1. Hypergolic ignition was observed with these dicyanamide-based ionic liquid fuels upon contact with the liquid oxidizer.

TABLE 1

IGNITION RESPONSE OF IONIC LIQUID FUEL WITH WHITE FUMING NITRIC ACID AND NITROGEN TETROXIDE

| Compound | WFNA | $N_2O_4$ |
|---|---|---|
| Methylhydrazidinium dicyanamide | Yes | Yes |
| Methylhydrazidinium tricyanomethanide | No | Yes |
| Propyl hydrazidinium dicyanamide | Yes | Yes |
| Diamino guanidinium dicyanamide | Yes | Yes |

With employment of dicyanamide or tricyanomethanide anions, a range of substituted hydrazidine-based ILs are available as high energy density fuels for bipropulsion applications.

In a preferred embodiment of the invention, the substituents to the cation confer low melting points and low viscosity while also incorporating structures that increase heat of combustion of the fuel with the storable liquid oxidizer. Such substituent (i.e., R-group) structures may be unsaturated (e.g., alkenyl- or alkynyl-), strained-ring (e.g., cyclopropyl-), or high-nitrogen moieties (e.g., azido-, cyano-, amino-, or hydrazino-).

The presence of at least two hydrazine moieties in the cations (Formula 2) influences the chemistry necessary for fast ignition. Table 2 displays ignition test results with three closely related IL fuels with varying amounts of hydrazine moieties in the cation (Formulas 3).

TABLE 2

IGNITION RESPONSE OF IL DICYANAMIDES WITH VARYING AMOUNT OF HYDRAZINO MOITIES IN THE CATION

| Dicyanamide Compound | Ignition with $N_2O_4$ |
|---|---|
| guanidinium dicyanamide | No |
| aminoguanidinium dicyanamide | No |
| diaminoguanidinium dicyanamide | Yes |

(Formulas 3)

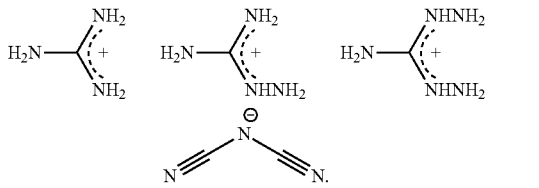

The following examples are intended to illustrate the present invention and should not be construed in limitation thereof.

Example 1

The synthesis of hydrazidine hydrochlorides was accomplished following literature procedures (Scheme 1). The conversion to dicyanamides or tricyanomethanides was achieved by exchanging the halide (prepared according to literature procedures or commercially-available) for the dicyanamide or tricyanomethanide using freshly prepared silver dicyanamide or silver tricyanomethanide (Scheme 2).

Scheme 1

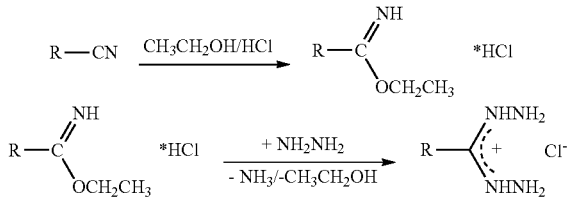

R is selected from the group consisting of H, $NH_2$, alkyl, alkenyl, alkylnyl, cycloalkyl-, azidoalkyl, cyanoalkyl, aminoalkyl, and hydrazinoalkyl and X is chloride, bromide, or iodide.

Scheme 2

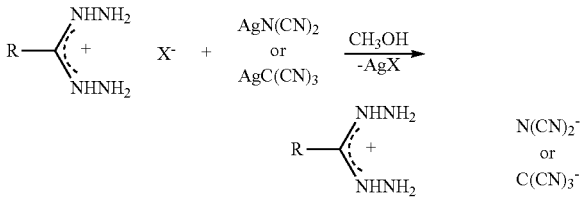

R is selected from the group consisting of H, $NH_2$, alkyl, alkenyl, alkylnyl, cycloalkyl-, azidoalkyl, cyanoalkyl, aminoalkyl, and hydrazinoalkyl and X is chloride, bromide, or iodide.

The general procedure for preparation of example salts includes equipping a 100 mL Schlenk flask with a Teflon® stir bar and purging the flask with dry nitrogen. Hydrazidinium chloride salts were added and dissolved in ca. 30 mL of methanol. In the dark, a ca. 5% excess of freshly prepared silver dicyanamide was added to the stirred solution. Stirring continued overnight. The insoluble silver halide and excess silver dicyanamide were removed by filtration. The solvent was removed under reduced pressure yielding the desired hydrazidinium liquid dicyanamides.

Acethydrazidinium Dicyanamide.

17.40 g (67.99 mmol) acethydrazidinium chloride ($C_2H_9N_4Cl$) used for anion exchange to dicyanamide ($C_4H_9N_7$): yield 86%; mp. (decomp.) 51° C.; density 1.35 g/cm$^3$.

Acethydrazidinium Tricyanomethanide.

2.66 g (11.72 mmol) acethydrazidinium chloride ($C_2H_9N_4Cl$) used for anion exchange to tricyanomethanide ($C_6H_9N_7$): yield 87%; mp. 71° C.; decomp. (onset) 100° C.; density 1.23 g/cm$^3$.

Butyrhydrazidinium Dicyanamide.

4.48 g (29.41 mmol) butyrhydrazidinium chloride ($C_4H_3N_4Cl$) used for anion exchange to dicyanamide ($C_6H_9N_7$): yield 80%; mp. 49° C.; decomp. (onset) 55° C.

Diaminoguanidinium Dicyanamide.

5.43 g (43.65 mmol) diaminoguanidinium chloride ($C_{13}H_8N_5Cl$) used for anion exchange to dicyanamide ($C_3H_8N_8$): yield 89%; mp. 61° C.; decomp. (onset) 112° C.; density 1.36 g/cm$^3$.

Diaminoguainidinium Tricyanomethanide.

0.94 g (7.49 mmol) diaminoguanidinium chloride ($C_{13}H_8N_5Cl$) used for anion exchange to tricyanomethanide ($C_5H_8N_8$): yield 92%; mp. 90° C.; decomp. (onset) 189° C.

Fast igniting, IL fuels thus provide a means to overcome significant limitations of the state-of-the-art, storable bipropulsion system. Such IL fuels can provide greater than 40% improvement in density over hydrazine fuels. This confers greater energy density to the bipropulsion system. Also, the negligible vapor pressure of IL fuel provides a means of significantly reducing costs and operational constraints associated with handling the fuel.

Prior to this invention fast igniting IL fuels were limited to the dicyanamide anion and to WFNA/RFNA/IRFNA as the only suitable oxidizers. The discovery of hypergolic activity of hydrazidine based ILs in combination with different anions towards $N_2O_4$ significantly increases the variety of suitable compounds and substantially improves operability and storability of the propulsion system ($N_2O_4$ possesses significant advantages over IRFNA, e.g. less corrosive). In addition new IL fuels with $N_2O_4$ can offer sizeable performance increase over IRFNA.

Also a preferred embodiment of the invention is the employment of pure hydrazidine-based IL as a fast-igniting, bipropellant fuel. However, the use of these IL salt molecules as a component in fuel mixtures to confer fast-ignition and density is also a viable mode of the invention.

A hypergolic bipropellant based upon IL fuel and an oxidizer (NTO/WFNA/RFNA/IRFNA) has potential as a replacement for bipropellants currently used in on-orbit spacecraft propulsion. Other application areas include liquid engines for boost and divert propulsion. The high volumetric impulse that is inherent in the new hypergol lends itself to applications that require high performance from volume limited systems. The low vapor toxicity of the IL fuel is a benefit over toxic hydrazine fuels currently used.

The performance aspects of this new hypergol can find use in commercial applications in satellite deployment and commercial space launch activities.

What is claimed is:

1. A hypergolic bipropellant comprising:

a) an ionic liquid fuel comprising:

(1) an open chain alkylhydrazidium cation having at least two hydrazine moieties; and (2) a dicyanamide anion; and b) nitrogen tetroxide operable as an oxidizer.

2. The hypergolic bipropellant of claim 1, wherein the ionic liquid fuel is synthesized according to a reaction:

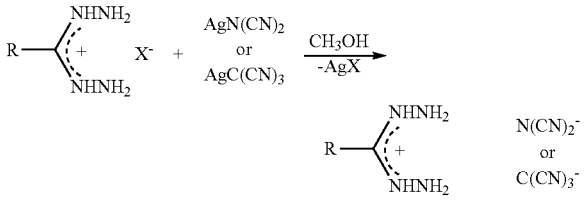

R is selected from the group consisting of H, $NH_2$, alkyl, alkenyl, alkylnyl, cycloalkyl, azidoalkyl, cyanoalkyl, aminoalkyl, and hydrazinoalkyl, and X is chloride, bromide, or iodide.

3. The hypergolic bipropellant of claim 1, wherein the open chain alkylhydrazidium cation has a formula:

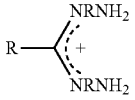

R is selected from the group consisting of H, $NH_2$, alkyl, alkenyl, alkylnyl, cycloalkyl, azidoalkyl, cyanoalkyl, aminoalkyl, and hydrazinoalkyl.

4. A hypergolic bipropellant comprising:

a) an ionic liquid fuel comprising:

(1) an open chain alkylhydrazidium cation having at least two hydrazine moieties; and (2) a dicyanamide anion; and b) nitric acid operable as an oxidizer.

5. The hypergolic bipropellant of claim 4, wherein the ionic liquid fuel is synthesized according to a reaction:

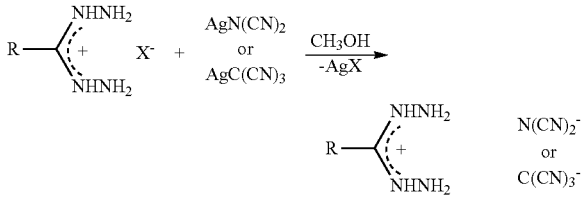

R is selected from the group consisting of H, $NH_2$, alkyl, alkenyl, alkylnyl, cycloalkyl, azidoalkyl, cyanoalkyl, aminoalkyl, and hydrazinoalkyl, and X is chloride, bromide, or iodide.

6. The hypergolic bipropellant of claim 4, wherein the open chain alkylhydrazidium cation has a formula:

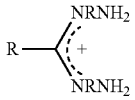

R is selected from the group consisting of H, $NH_2$, alkyl, alkenyl, alkylnyl, cycloalkyl, azidoalkyl, cyanoalkyl, aminoalkyl, and hydrazinoalkyl.

* * * * *